US008602275B1

(12) United States Patent
Kiger et al.

(10) Patent No.: US 8,602,275 B1
(45) Date of Patent: Dec. 10, 2013

(54) QUICK RELEASE DEVICE FOR HOLSTER

(75) Inventors: Justin Kiger, Standish, ME (US); Frank A. Howell, Oxford, ME (US)

(73) Assignee: Here Be Dragons, LLC, Oxford, ME (US)

( * ) Notice: Subject to any disclaimer, the term of this patent is extended or adjusted under 35 U.S.C. 154(b) by 405 days.

(21) Appl. No.: 13/170,776

(22) Filed: Jun. 28, 2011

(51) Int. Cl.
*F41C 33/02* (2006.01)

(52) U.S. Cl.
USPC ..... 224/243; 224/238

(58) Field of Classification Search
USPC ..... 224/192, 193, 198, 196, 238, 242–244, 224/911, 912
See application file for complete search history.

(56) References Cited

U.S. PATENT DOCUMENTS

| | | | | |
|---|---|---|---|---|
| 5,127,566 | A | 7/1992 | Beletsky | |
| 5,501,381 | A | 3/1996 | Rogers et al. | |
| 5,944,239 | A | 8/1999 | Rogers et al. | |
| 6,371,341 | B1 | 4/2002 | Clifton, Jr. | |
| 6,467,660 | B1 | 10/2002 | Rogers et al. | |
| 7,461,765 | B2 * | 12/2008 | French et al. | 224/243 |
| 7,556,181 | B2 * | 7/2009 | Spielberger | 224/244 |
| 2004/0050887 | A1 * | 3/2004 | Spielberger | 224/244 |

* cited by examiner

*Primary Examiner* — Justin Larson
*Assistant Examiner* — Corey Skurdal
(74) *Attorney, Agent, or Firm* — Gesmer Updegrove LLP

(57) ABSTRACT

A quick release device for preventing unwarranted withdrawal of a hand gun from a holster, comprising a thumb actuated hood translatably fixed with respect to and rotatable about a fixed axis between a rearward position overlying the holster opening and a forward position removed therefrom.

7 Claims, 7 Drawing Sheets

QUICK RELEASE DEVICE FOR HOLSTER

FIELD OF THE INVENTION

This invention relates generally to side arm holsters, and is concerned in particular with a quick release device for preventing unwanted withdrawal of the side arms from such holsters.

BACKGROUND DISCUSSION

Military personnel and law enforcement officers frequently carry side arms contained in holsters. The holsters may be fabricated from various materials, including leather, hard plastics, fabrics, etc.

Various devices are employed to secure the side arms against unwanted withdrawal. For example, some devices rely on straps secured by snaps. However, snaps generally function in only one direction, lack durability, are easy to foul, and are difficult to replace when worn or damaged.

Some hard plastic holsters have button activated locks which engage the trigger guard of the side arm. This allows easy access to the grip of the weapon, but requires movement of the trigger finger to actuate the release button. The location of the release button is not adjustable to accommodate different sized hands, and it may also be difficult to operate the release on this style of holster while wearing gloves. Moreover, requiring movements of the trigger finger to deactivate the lock could be dangerous if any such movements continue into the draw action and engage the trigger.

Other devices, such as for example the device described in U.S. Pat. No. 6,467,660 employ a rotatable hood. In its locked position, the hood covers the grip of the side arm. In order to withdraw the side arm from the holster, the hood must first be pushed downwardly to bodily translate it to an unlocked condition, followed by forward rotation to clear it from the grip of the side arm. A drawback with this type of mechanism is that it can be unlocked and rotated open by an inadvertent downward and forward impact against the prominently positioned hood/strap, or worse by a frontal assailant grabbing at the side arm with a "raking" motion.

When withdrawing a side arm restrained by this device, the marksman's hand must land on the top of the hood, push it down and forward then reach back to grip the side arm and draw it out of the holster. This two step procedure is suboptimal when the marksman is confronted with an urgent situation. Another, perhaps faster, procedure is to grip the butt of the side arm and place the thumb on a land fashioned into the side of the hood. To draw the side arm, the thumb first pushes the land down to draw the hood downward into the unlocked position, and then the thumb drives the hood forward, rotating it free of the weapon. This draw method is also suboptimal because the palm of the hand is pulled awkwardly away from the grip of the side arm as the thumb is used to drive the hood forward into the disengaged position. Although the hand remains, generally, in closer proximity to the grip of the side arm, the marksman must still shift the palm of the hand back down to re-grip the side arm, compromising the stability of marksman's hand at this critical moment.

Also, this device positions the pivot point of the hood directly beneath the hood. With this arrangement, the leading edge of the hood moves downwardly as it begins its forward rotation from its location in vertical alignment with the pivot point. If the side arm is not fully inserted into the holster and is thus in contact with the hood, the side arm must first be pushed further down into the holster to create enough clearance for the hood to start its rotation.

Many known hood retention devices are restricted in application to rigid or semi-rigid holsters. These types of holsters also typically use screw-type clamping devices to establish a fixed amount of frictional retention to stabilize the side arm in the holster when the hood is in the unlocked position. Rigid or semi-rigid holsters are more expensive to produce than those constructed of sewn fabrics and typically are custom contoured to fit only one make/model of a side arm. However, holsters constructed with flexible sewn fabrics do not have the stability to mount easily operated mechanical weapon retention devices.

Generally stated, the objective of the present invention is to provide an improved quick release device for preventing unwarranted withdrawal of a side arm from a holster which avoids or at least significantly mitigates the above described problems associated with known side arm retention devices.

SUMMARY OF THE INVENTION

A quick release device in accordance with the present invention is designed for use with a holster having an opening through which a side arm is inserted into and removed from the holster pocket. The device comprises a generally U-shaped hood having mutually spaced legs spanned by a bridge. The legs are arranged to straddle exterior sides of the holster, with the hood being translatably fixed with respect to and rotatable about a fixed axis. The hood is rotatable between a rearward position at which the bridge overlies the holster opening to prevent withdrawal of the side arm, and a forward position removed from the holster opening to permit withdrawal of the side arm.

At least one plate is fixed with respect to an exterior side of the holster at a location adjacent to one of the hood legs. The plate defines a slot bordered by an edge leading from a locking notch to a stop.

A shaft projects from the one hood legs into the slot. The shaft is shiftable with respect to the one hood leg and within the slot. A spring or the like serves to resiliently urge the shaft into the locking notch when the hood is in its rearward position, with the interengagement of the shaft in the locking notch serving to lock the hood in place.

A thumb actuated mechanism is provided for shifting the shaft out of the locking notch and forwardly along the slot edge to the stop to thereby effect rotation of the hood to its forward position.

Preferably, the shaft comprises the axle of at least one rotatable wheel with the wheel serving as the thumb actuated mechanism.

Advantageously, the fixed axis of rotation is located forwardly of the locking notch, and the slot edge extends from the locking notch to the stop in a direction angularly away from the axis of rotation.

The quick release device of the present invention may further comprise a generally U-shaped saddle having arms straddling and fixed to the exterior sides of the holster, with the legs of the hood being mounted on the saddle arms for rotation about the fixed axis.

Preferably, the one leg of the hood is sandwiched between two plates, with each plate defining one of the slots, and with the slots having aligned edges, locking notches and stops, and with the shaft projecting into both slots.

These and other features and attendant advantages of the present invention will now be described in greater detail with reference to the accompanying drawings, wherein:

DETAILED DESCRIPTION

Figure 1:
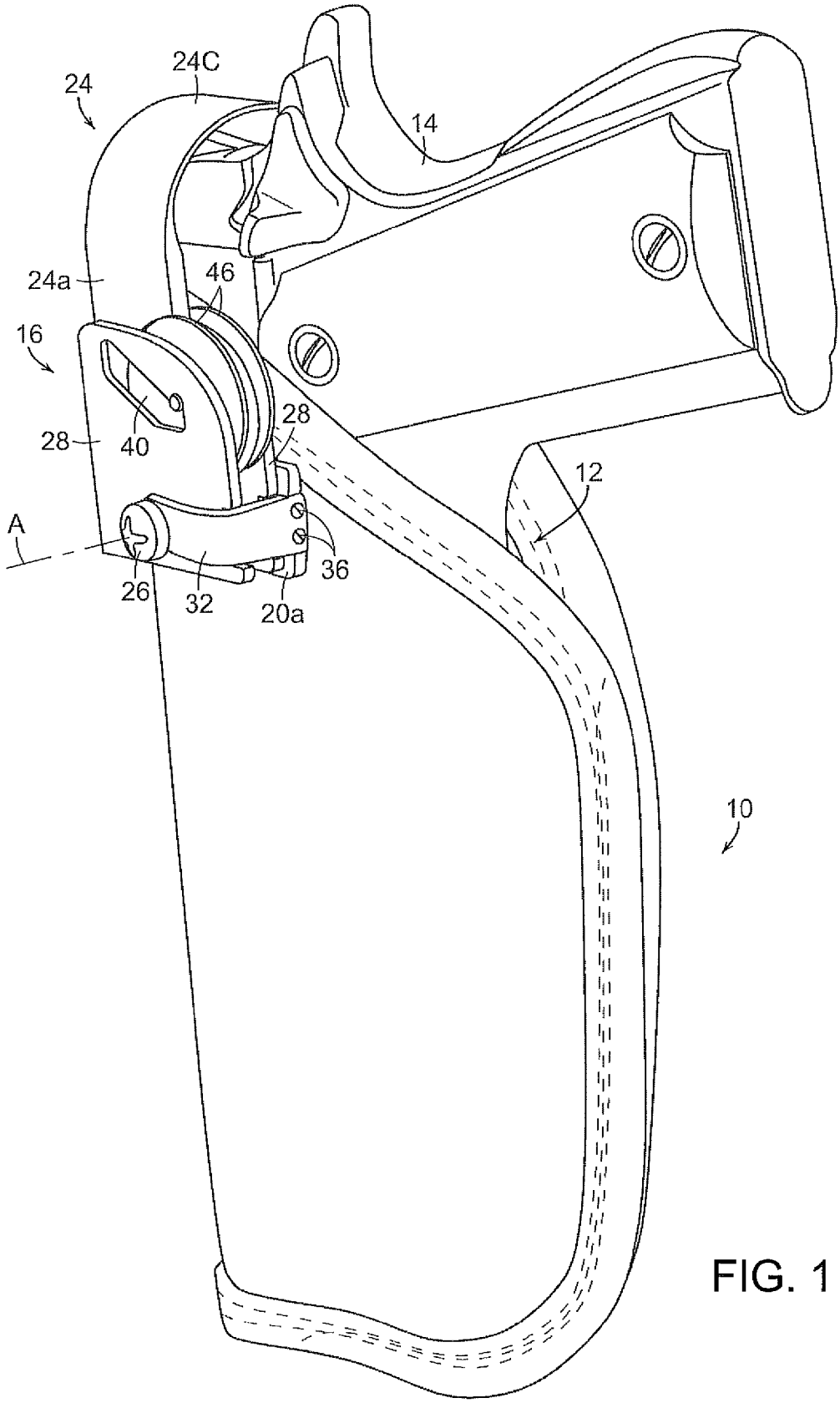
FIG. 1 is a front perspective view of a side arm holster with a quick release device in accordance with the present invention showing the hood in its locked rearward position preventing withdrawal of the side arm.

With reference to the drawings, a typical soft-sided side arm holster 10 has an open upper end 12 through which a hand gun 14 may be inserted into and removed from the holster pocket. A quick release device 16 in accordance with the present invention comprises saddle 18 extending across the front of the holster, with arms 20*a*, 20*b* received and fixed in pockets 22 on each side of the holster.

Figure 2:
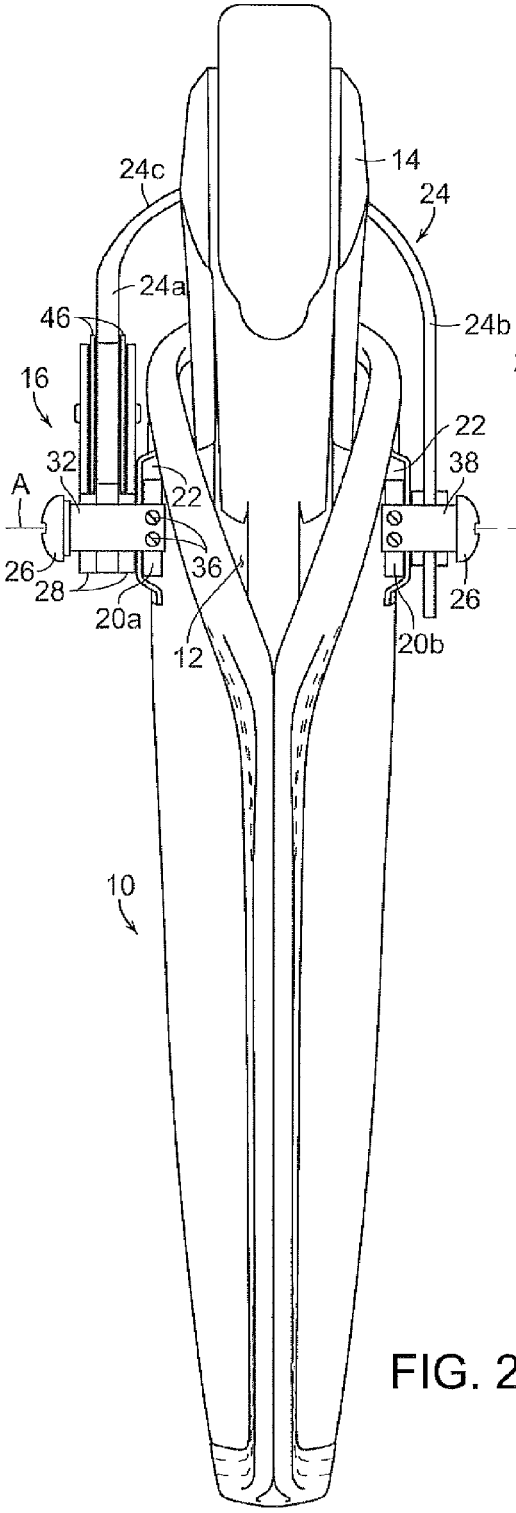
FIG. 2 is a rear elevational view of the holster.
Figure 3:
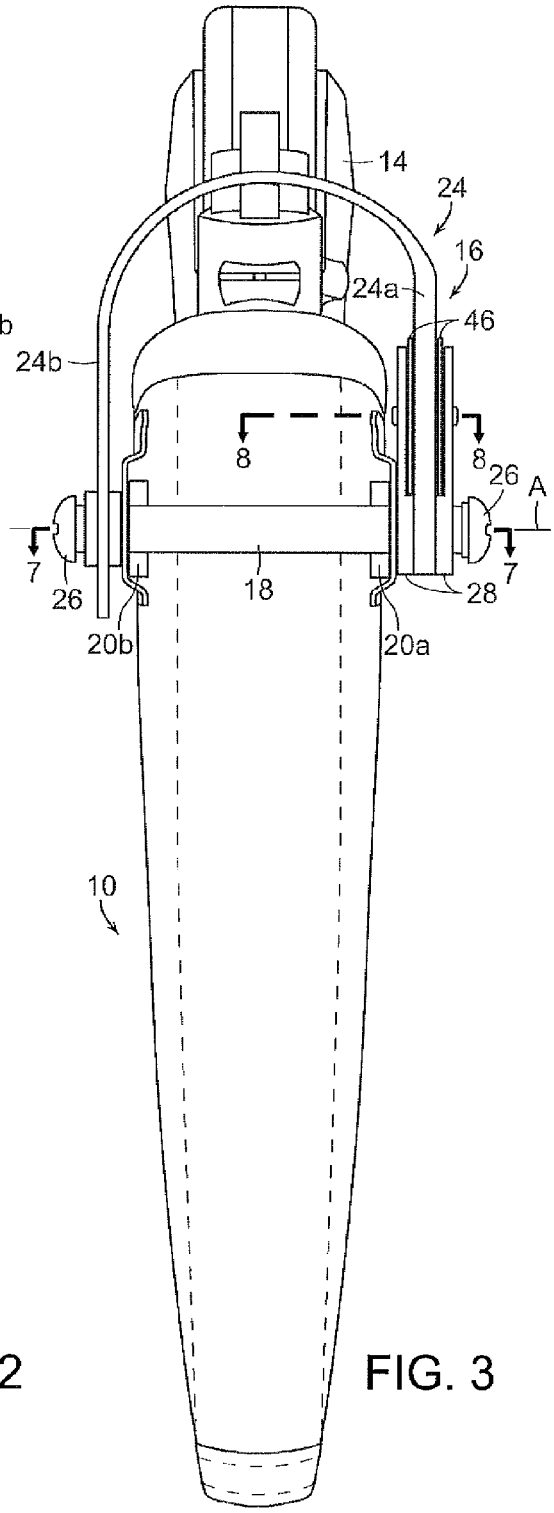
FIG. 3 is front elevational view of the holster.
Figure 6:
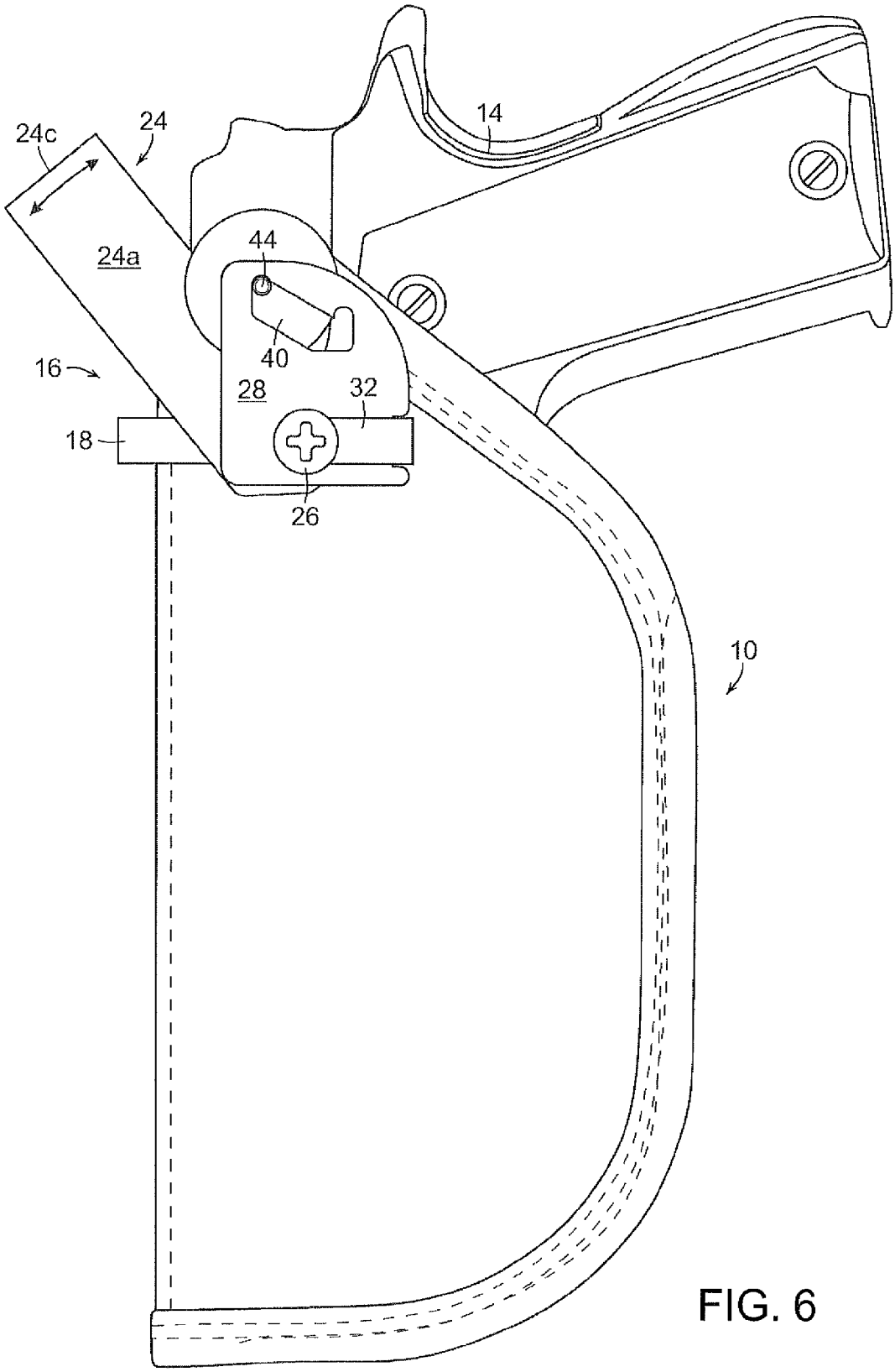
FIG. 6 is a side elevational view of the holster with the hood in its forward position clearing the way for withdrawal of the hand gun from the holster.

A generally U-shaped hood 24 has mutually spaced legs 24*a*, 24*b* spanned by a bridge 24*c*. The legs 24*a*, 24*b* are arranged to straddle the holster, and are mounted on the saddle arms 20*a*, 20*b* by means of screws 26 or the like for rotation about an axis "A". The hood 24 is thus translatably fixed with respect to and rotatable about axis A between a rearward position (as shown in FIGS. 1-3) at which the bridge 24*c* overlies the holster opening 12 to prevent withdrawal of the hand gun 14 from the holster, and a forward position (as shown in FIG. 6) at which the bridge is removed from the holster opening to permit withdrawal of the hand gun.

At least one and preferably two plates 28 are fixed with respect to the holster at locations adjacent to and sandwiching one of the hood legs 24*a* therebetween. The plates 28 are mirror images of each other, and are fixed with respect to each other by one of the screws 26 and by a companion fastener 30.

Figure 7:
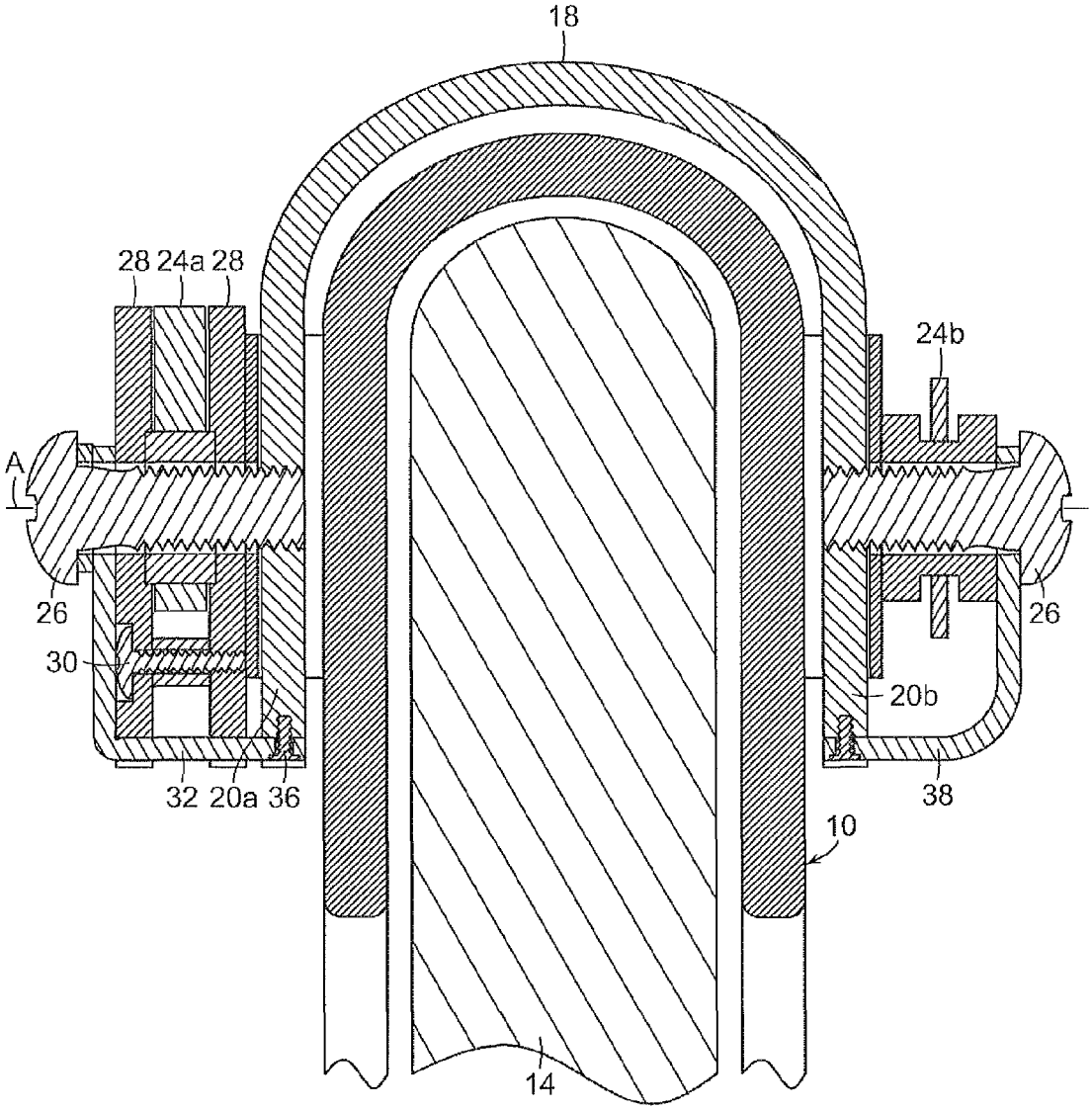
FIGS. 7 and 8 are enlarged horizontal sectional views taken respectively along lines 7-7 and 8-8 of FIG. 3.

As can be best seen in FIG. 7, a retaining strap 32 is secured at one end by one of the screws 26 and extends around notches 34 in the rear edges of the plates 28 where it is fastened by screws 36 or the like to one of the arms 20*a* of the saddle 18. The plates 28 are thus fixed with respect to the saddle 18 which in turn is fixed with respect to the holster 10. A companion strap 38 extends from the other arm 20*b* of the saddle 18 to the screw 26 providing rotatable support for the other leg 24*b* of the hood 24.

Each plate 28 defines a slot 40 partially bordered by ramp-like edge 40*a* leading from a locking notch 40*b* to a stop 40*c* in a direction angularly away from the rotational axis A. As can be best seen in FIG. 4, the hood leg 24*a* defines a slot 42 extending transversely with respect to the slot edges 40*a* in the plates 28.

Figure 4:
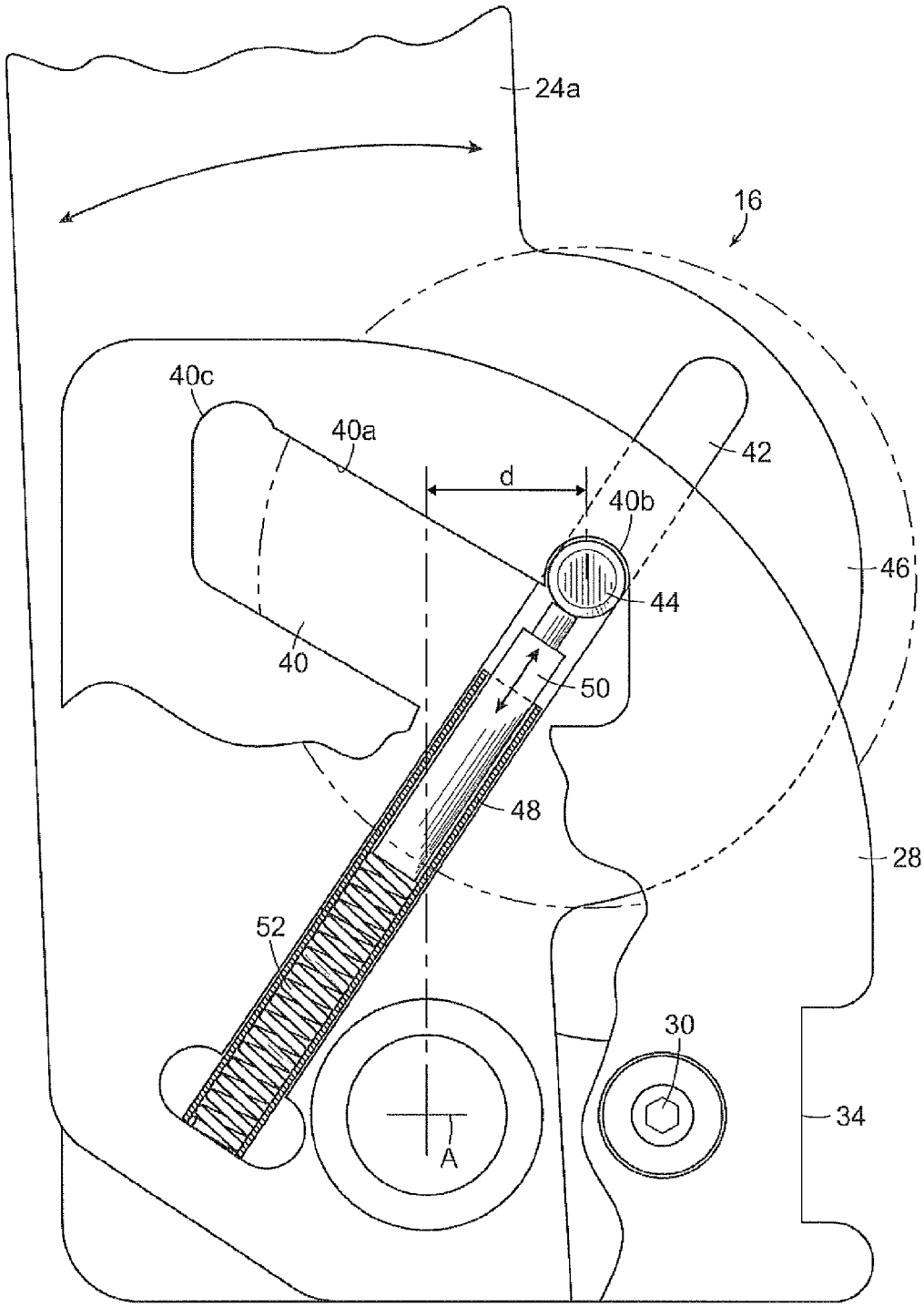
FIG. 4 is an enlarged partially broken away side elevation of the quick release device.
Figure 8:
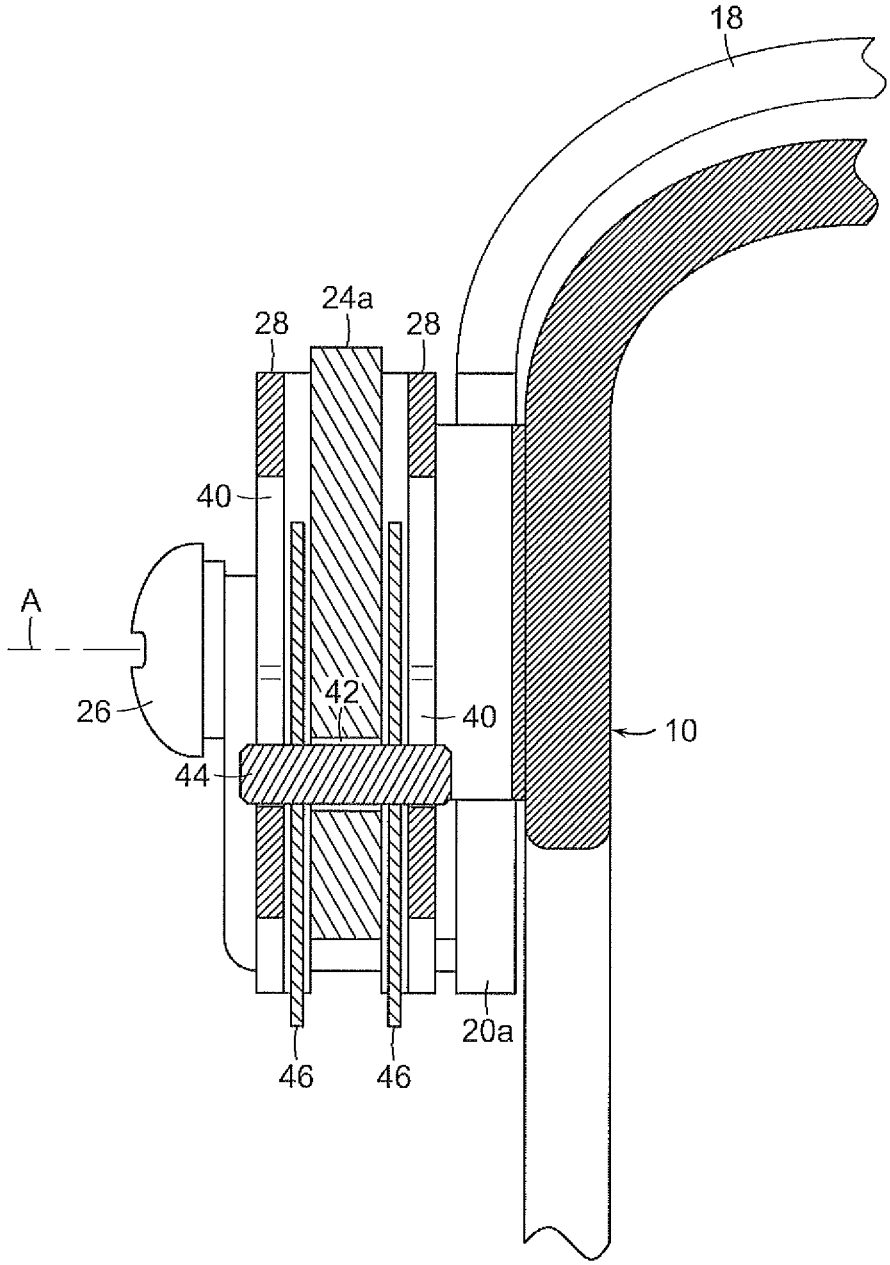

As shown by reference to FIGS. 4 and 8, a shaft 44 extends across slot 42 and projects into the slots 40 of both plates. The shaft 44 preferably serves as the axle of at least one and advantageously two thumb engageable wheels 46.

A tube 48 is retained within the slot 42 in the hood leg 42*a*. The tube contains a pin 50 loaded by a spring 52. The pin 50 serves to resiliently urge the shaft 44 into the locking notch 40*b* when the hood 24 is in its rearward position. The interengagement of the shaft with the locking notch serves to lock the hood in its rearward position.

Figure 5A:
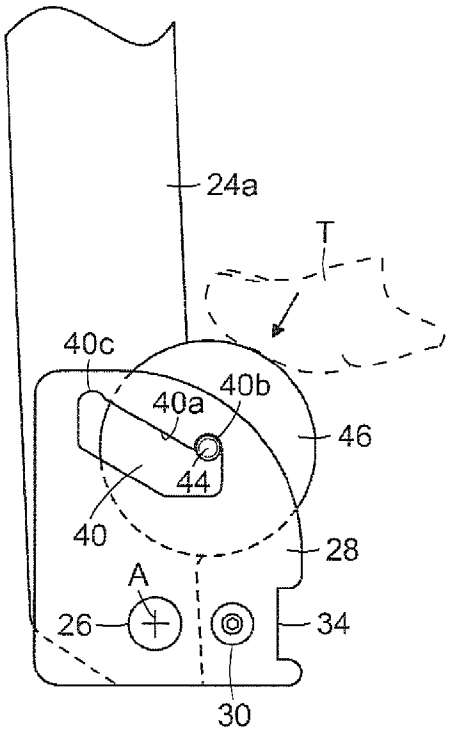
FIG. 5A-5C are diagrammatic illustrations showing successive movement of components of the quick release device during movement of the hood from its rearward locked position to its forward position.

The releasable locking mechanism of the present invention is positioned with respect to the side of the holster such that when the butt of a hand gun is gripped, the marksman's thumb "T" as shown in FIG. 5A, can readily access and engage the wheels 46.

Figure 5B:
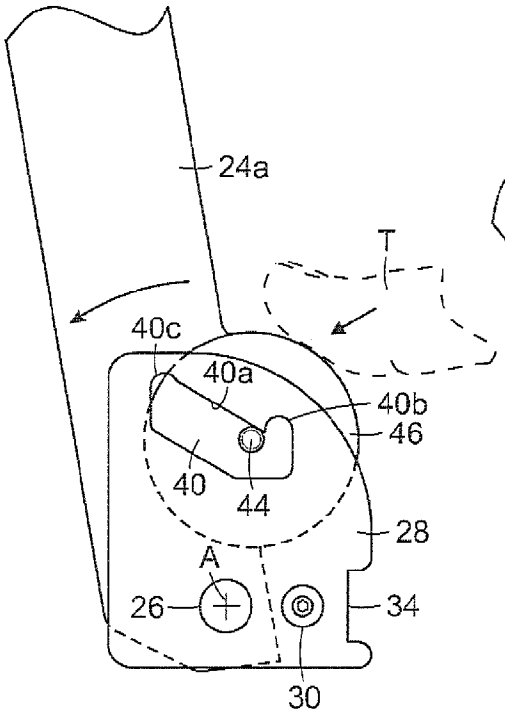
Figure 5C:
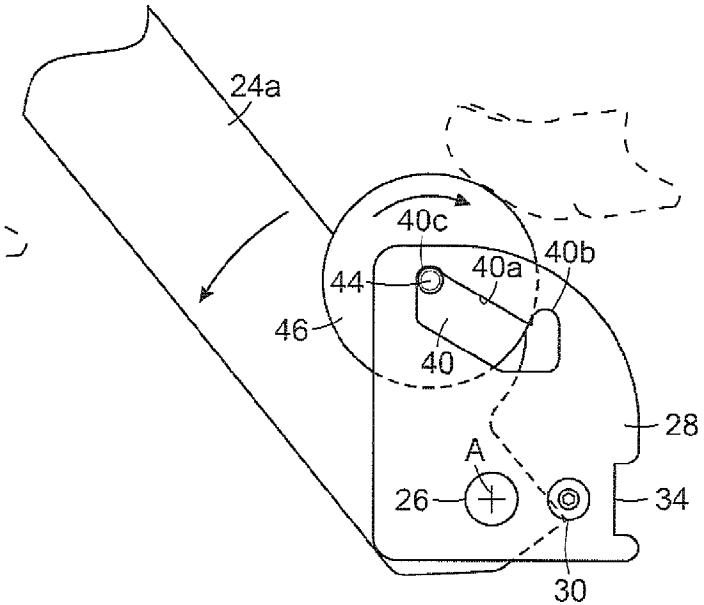

Then, as shown in FIG. 5B, the wheels can be pressed against the resilient force of the spring 52 to move the shaft 44 out of the locking notch 40*b*. Once out of the locking notch, and as shown in FIG. 5C, the shaft can be moved along the slot edge 40*a* to the stop 40*c*, with an accompanying rotation of the hood 24 about axis A to its forward position, as shown in FIG. 6. As this occurs, the wheels 46 rotate in a clockwise direction to allow the thumb T to descend toward an optimal gripping position against the butt of the firearm. Clockwise wheel rotation also allows the thumb to drive the hood 24 forwardly without lifting the marksman's palm from the butt of the firearm.

As can be best seen in FIG. 4, the rotational axis A of the hood 24 is displaced forwardly of the locking notch 40*b* by a distance "d". As the hood is rotated to its forward position, its bridge 24*c* rotates upwardly away from the hand gun, thus avoiding or at least minimizing any contact that would interfere with hood rotation. Additionally, with this spatial arrangement, any attempt to rotate the hood forwardly without first dislodging the shaft 44 from the locking notch 40*b* will only result in the shaft being urged more securely in the locking notch.

Also, because the hood is translatably fixed with respect to the rotational axis A in its rearwardly locked position, downward and forward impact either inadvertently by the wearer of the holster or purposely by a frontal assailant will be ineffective in releasing the hood from its securely locked position.

Because the slot edge 40*a* extends angularly away from axis A, once the shaft 44 is dislodged from the locking notch 40*b*, the resilient force of spring 52 now co-acts with the slot edge to urge the shaft 44 towards the stop 40*c*. In effect, this produces a snap action of the hood into its forward position. When securing a hand gun in the holster, the hood 24 need only be rotated back to its locked position. The angular orientation of the slot edge 40*a* will serve to gradually compress the spring 52 as the shaft 44 moves along the slot edge until it is eventually snapped into the locking notch 40*b*.

What is claimed is:

1. A quick release device for preventing unwanted withdrawal of a hand gun from a holster, said holster having an opening through which the hand gun is inserted into and removed from the holster, said device comprising:

a generally U-shaped hood having mutually spaced legs spanned by a bridge, said legs being arranged to straddle said holster, with said hood being translatably fixed with respect to and rotatable about a fixed axis between a rearward position at which said bridge overlies said opening to prevent withdrawal of the hand gun from said holster, and a forward position at which said bridge is removed from said opening to permit withdrawal of the hand gun from said holster;

at least one plate fixed with respect to said holster at a location adjacent to one of said legs, said plate defining a slot bordered by an edge leading from a locking notch to a stop;

a shaft projecting from the said one leg into said slot, said shaft being shiftable with respect to the said one leg and within said slot in a direction transverse to said edge;

means for resiliently urging said shaft into said locking notch when said hood is in said rearward position, the interengagement of said shaft with said notch serving to lock said hood in said rearward position; and thumb actuated means for shifting said shaft out of said locking notch and forwardly along said edge to said stop to thereby effect rotation of said hood from said rearward position to said forward position.

2. The device of claim 1 wherein said shaft comprises the axle of at least one wheel, with the wheel serving as said thumb actuated means.

3. The device of claim 1 wherein said fixed axis is located forwardly of said locking notch.

4. The device of claim 3 wherein the said edge of said slot extends from said locking notch to said stop in a direction angularly away from said axis.

5. The device of claim 1 further comprising a generally U-shaped saddle having arms straddling and fixed to exterior sides of said holster, the legs of said hood being mounted on said arms for rotation about said fixed axis.

6. The device of claim 1 wherein the said one leg is sandwiched between two of said plates, said plates each defining one of said slots with aligned edges, locking notches and stops, with said shaft projecting into both of said slots.

7. A quick release device for preventing unwanted withdrawal of a hand gun from a holster, said holster having an opening through which the hand gun is inserted into and removed from the holster, said device comprising:

a hood mounted on said holster for rotation about an axis between a rearward position overlying said opening to prevent withdrawal of the hand gun from said holster, and a forward position removed from said opening to permit withdrawal of the hand gun from said holster;

at least one plate fixed with respect to said holster at a location adjacent to said hood, said plate defining a slot bordered by an edge extending angularly away from said axis and leading from a locking notch positioned rearwardly of said axis to a stop positioned forwardly of said axis;

a shaft projecting from said hood into said slot, said shaft being shiftable with respect to said hood and within said slot in a direction transverse to said edge;

means for resiliently urging said shaft into said locking notch when said hood is in said rearward position, the interengagement of said shaft with said notch serving to lock said hood in said rearward position; and thumb actuated means for shifting said shaft out of said locking notch and forwardly along said edge to said stop to thereby effect rotation of said hood from said rearward position to said forward position.

* * * * *